United States Patent [19]

Pennington

[11] Patent Number: 4,893,405

[45] Date of Patent: Jan. 16, 1990

[54] METHOD OF CORRECTING CONNECTORS TO LEADS ON PCBS

[75] Inventor: Roy E. Pennington, Loveland, Colo.

[73] Assignee: Hewlett-Packard Company, Palo Alto, Calif.

[21] Appl. No.: 269,851

[22] Filed: Nov. 9, 1988

Related U.S. Application Data

[62] Division of Ser. No. 44,084, Apr. 29, 1987, Pat. No. 4,804,335.

[51] Int. Cl.[4] ..... H01R 43/00

[52] U.S. Cl. ..... 29/857; 361/413; 361/415; 439/460

[58] Field of Search ..... 29/857; 361/413, 415, 361/399; 439/160

[56] References Cited

U.S. PATENT DOCUMENTS

| | | | |
|---|---|---|---|
| 3,693,135 | 9/1972 | Vavrick et al. | 361/413 X |
| 3,710,197 | 1/1973 | Olds et al. | 361/425 X |
| 3,784,954 | 1/1974 | Grimm et al. | 361/399 X |
| 3,829,741 | 8/1974 | Athey | 361/415 X |
| 3,932,016 | 1/1976 | Ammenheuser | 361/415 X |
| 4,345,809 | 8/1982 | Sugden | 439/160 |
| 4,454,552 | 6/1984 | Barnes et al. | 361/413 X |
| 4,594,332 | 3/1986 | Calabro | 361/413 |

*Primary Examiner*—Howard N. Goldberg
*Assistant Examiner*—Carl J. Arbes
*Attorney, Agent, or Firm*—Edward L. Miller

[57] ABSTRACT

A mass interconnect system connects and disconnects one or more banks of electrical connectors to and from the electrical leads of a plurality of printed circuit cards supported at an opening in a mainframe card cage. The mass interconnect system includes: (a) a frame assembly supported by the mainframe card cage; (b) a plurality of retractable support members carried by the frame assembly; (c) arm means carried by the frame assembly, for moving the support members outwardly from the frame and inwardly toward the frame; and (d) module means for carrying the bank(s) of electrical connectors. The module means is detachably mounted to the support members such that the electrical connectors are aligned with and coupled to the electrical leads on the printed circuit cards in the mainframe card cage when the arm means is moved from a first position to a second position. A terminal block is also provided for housing and supporting the electical connectors. The terminal block includes alignment menas to align the bank of electrical connectors with the electrical leads on the printed circuit card in the mainframe card cage. A plurality of terminal blocks may be detachably mounted in the module means.

1 Claim, 11 Drawing Sheets

METHOD OF CORRECTING CONNECTORS TO LEADS ON PCBS

CROSS REFERENCE TO RELATED APPLICATION

This is a division of application Ser. No. 044,084, filed Apr. 29, 1987 now U.S. Pat. No. 4,804,335 issued Feb. 14, 1989.

FIELD OF THE INVENTION

This invention relates to electrical connection systems and techniques. More particularly, this invention relates to systems for connecting electrical test equipment to apparatus which is being tested. Even more particularly, this invention relates to systems and techniques for quickly and efficiently connecting and disconnecting a plurality of electrical connectors to leads on printed circuit cards contained in a mainframe card cage.

BACKGROUND OF THE INVENTION

Operating parameters of electrical equipment must often be measured or determined for a variety of reasons. For example, a complex electrical circuit within an aircraft or in a component used in an aircraft requires thorough electrical testing to verify its usefulness and reliability. Similarly, complex electrical circuitry present in other working environments also requires thorough testing to determine its reliability.

Typically, the manner in which complex electrical circuitry has heretofore been tested involved hard wiring (i.e., permanent attachment) of incoming signal lines from the devices under test to a test fixture. The test fixture normally utilized a pin and a cantilever spring concept. Undesired bending of the contacts in the test fixture made it difficult for the user to re-align the contacts for proper use. Another disadvantage of such manner of testing is that the fixture assembly is hardwired and therefore dedicated to a particular test requirement. This type of test system was not only expensive but also inherently limiting in its adaptability.

SUMMARY OF THE PRESENT INVENTION

In accordance with the present invention there are provided unique systems and apparatus for quickly and easily connecting and disconnecting a plurality of electrical connector to the electrical leads on printed circuit cards in a mainframe card cage (i.e., a measurement system used to perform measurements of operating parameters of the equipment or apparatus being tested).

In one aspect the invention provides a terminal block for housing and supporting electrical connectors and for aligning the connectors with electrical leads on a printed circuit card supported in a mainframe card cage. The terminal block may accommodate banks of standard electrical connectors which may be the same or different, depending upon the configurations of the electrical leads with which it is desired to interface the electrical connectors. Typically the electrical connectors used in the terminal block are adapted to slidably engage the electrical leads on a printed circuit card.

In another aspect the invention provides an interconnect module for supporting one or more of the terminal blocks. The interconnect module is adapted to interface the bank or banks of electrical connectors in a terminal block with the electrical leads on a printed circuit card in a mainframe card cage. The interconnect module may be adapted to support many of the terminal blocks at one time. For example, the interconnect module may be adapted to support up to ten or even more terminal blocks as a unit.

The interconnect module includes a frame member and retention means for detachably retaining the terminal blocks in the frame member. Thus, different combinations of terminal blocks may be supported in the interconnect module at different times for different types of test requirements.

In another aspect the invention provides an interconnect system for connecting and disconnecting one or more banks of electrical connectors to and from the electrical leads of a printed circuit card supported in a mainframe card cage. The interconnect system comprises:

(a) a frame assembly attached to and supported by the mainframe card cage at an opening at which the electrical leads on one or more printed circuit cards are accessible;

(b) a plurality of retractable support members carried by the frame assembly;

(c) arm means carried by the frame assembly, the arm means being pivotable between first and second positions, the arm means being adapted to move the support members outwardly from the frame assembly when the arm means is in its first position, and the arm means being adapted to move the support members inwardly toward the frame assembly when the arm means is in its second position; and (d) module means for carrying one or banks of electrical connectors, wherein the module means is adapted to be attached to the retractable support members in a manner such that the electrical connectors are aligned with and couple to the electrical leads when the arm means is moved from its first position to its second position.

The interconnect system of this invention enables several banks of electrical connectors to be quickly and easily connected to, or disconnected from, the leads on several printed circuit cards in a measurement system. All of the electrical connectors can be connected or disconnected simultaneously.

An interconnect module can be easily and quickly disconnected and replaced with another interconnect module without having to re-wire connectors. This allows faster and more complete testing to be done. Changing from one type of testing to another type of testing can be done quickly and simply. The terminal blocks can be used as stand alone test devices (i.e., they can be individually interfaced with the electrical leads on a printed circuit card in a mainframe computer) or they can be included as part of a more complex test configuration where several terminal blocks are supported in a single interconnect module.

Also, individual terminal blocks can be removed from an interconnect module and replaced with different terminal blocks which are already wired to the electrical circuitry or component to be tested. This allows for more efficient testing procedures.

The interconnect system of the invention also provides for accurate, effective, and automatic alignment of the electrical connectors in the terminal blocks with the electrical leads on the printed circuit cards in the mainframe computer. This avoids many of the problems encountered in the past involving attempts to obtain proper alignment of the electrical connectors with the electrical leads on a printed circuit card.

The interconnect system of the invention enables great flexibility in the types of test capabilities which are possible. It also enables simple re-configuration of the terminal blocks for any desired type of testing to be done.

Other advantages of the system of the invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
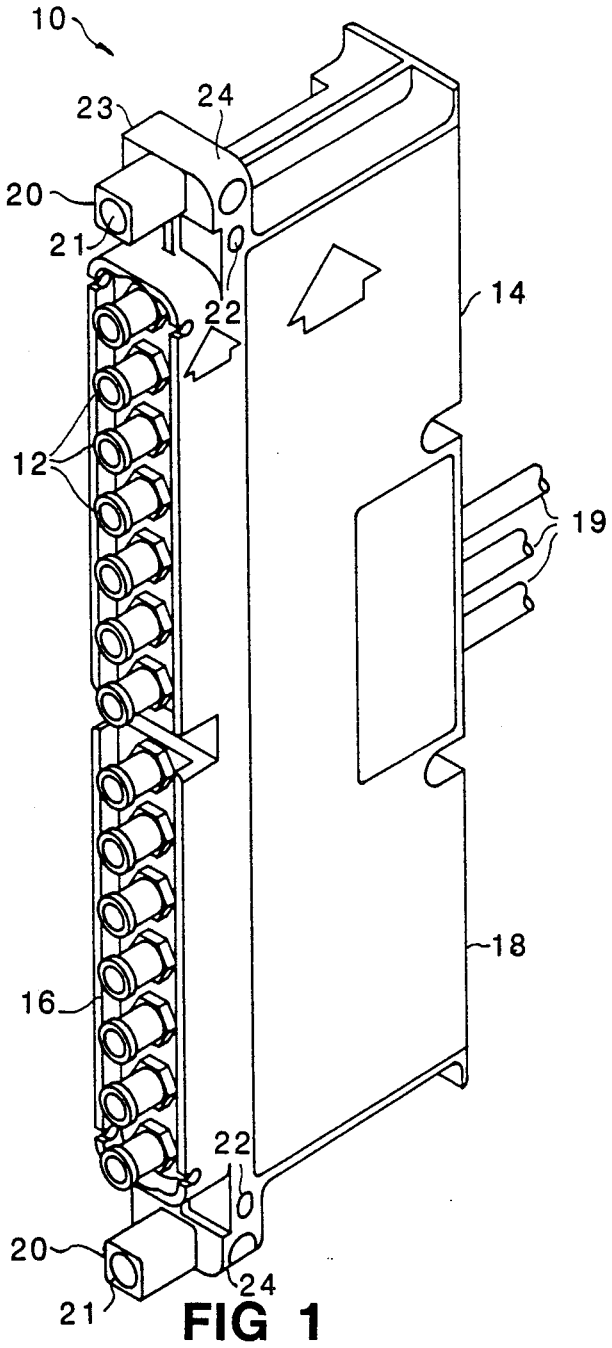
FIG. 1 is a perspective view of a novel terminal block which is useful in the present invention.

Thus, in the drawings there is shown a terminal block 10 for housing and supporting a plurality of electrical connectors 12 in a housing 14 having a front face 16 and a rear face 18. The bank of electrical connectors is accessible at the front face of the housing, as illustrated.

Each electrical connector is in operative contact with an elongated electrical conductor 19 (e.g., a wire or cable) which extends rearwardly through the rear face of the housing. The electrical conductors 19 are adapted to extend to the particular electrical equipment to be tested.

The front face of the housing 14 preferably includes alignment means comprising projections 20 which extend outwardly, as illustrated. Each projection includes an aperture or opening 21 therethrough which is adapted to align with, and slidably engage, alignment pins projecting outwardly from the printed circuit card to which the electrical connectors are to be coupled. The outward end of each aperture or opening 21 may be beveled to facilitate entry of the alignment pins into the opening.

The types of electrical connectors which are mounted in the terminal block may vary. For example, they may be coaxial cable connectors or series connectors. These types of electrical connectors are conventional and well known. For example, they may be high frequency bnc, coaxial connectors, Din E series connectors, etc. Other types of connectors may also be used, if desired. The types of electrical connectors used in a particular terminal block will be determined by the types of electrical leads on the printed circuit card with which the terminal block is to be interfaced.

The housing 14 also preferably includes upper and lower transverse openings or apertures 22, as illustrated, which extend completely through the housing 14 from one side to the opposite side thereof. The apertures are parallel to the front face of the housing.

The apertures 22 are each adapted to slidably receive an elongated rod after the terminal block has been inserted into an interconnect module, as hereafter described. In this manner the terminal block can be releasably retained in the interconnect module, and the terminal block may be removed from the module when the rod is withdrawn.

The front face of the housing 14 further includes means for assuring that the terminal block is properly inserted into an interconnect module. On one side of the front portion of the housing 14 there are square corners 23 (top and bottom edge) while on the opposite side there are round corners 24.

Figure 4:
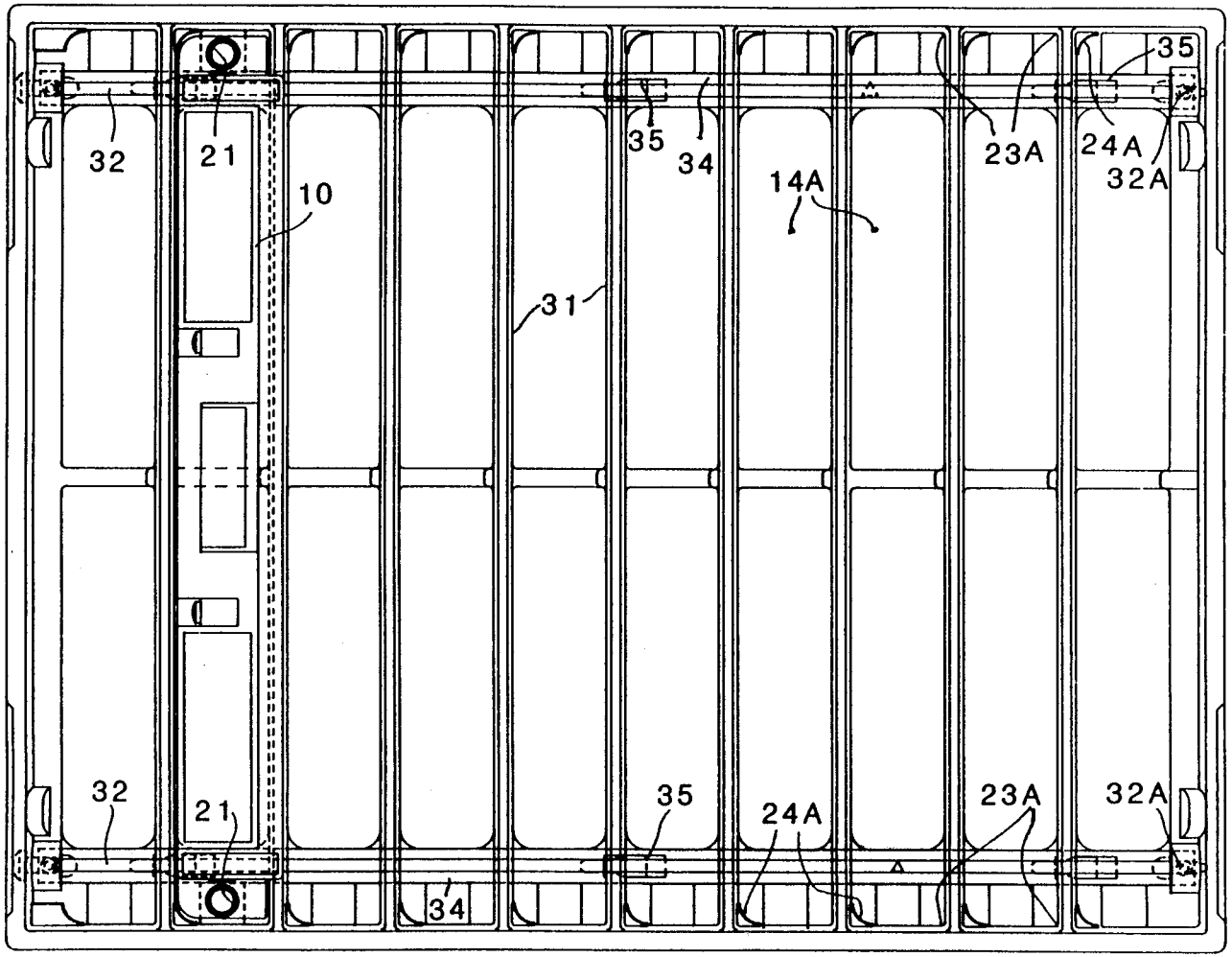
FIG. 4 is a rear elevational view of the interconnect module and terminal block combination shown in FIG. 3.

The interconnect module includes slots or compartments 14A for slidably receiving the terminal blocks. One side of each such compartment includes square corners 23A to accommodate the square corners of the front portion of the terminal block. The opposite side of each compartment includes rounded or curved corners 24A which can accommodate only the rounded corners of the terminal block This is best illustrated in FIG. 4 (which is a rear elevational view of the interconnect module).

Figure 2A:
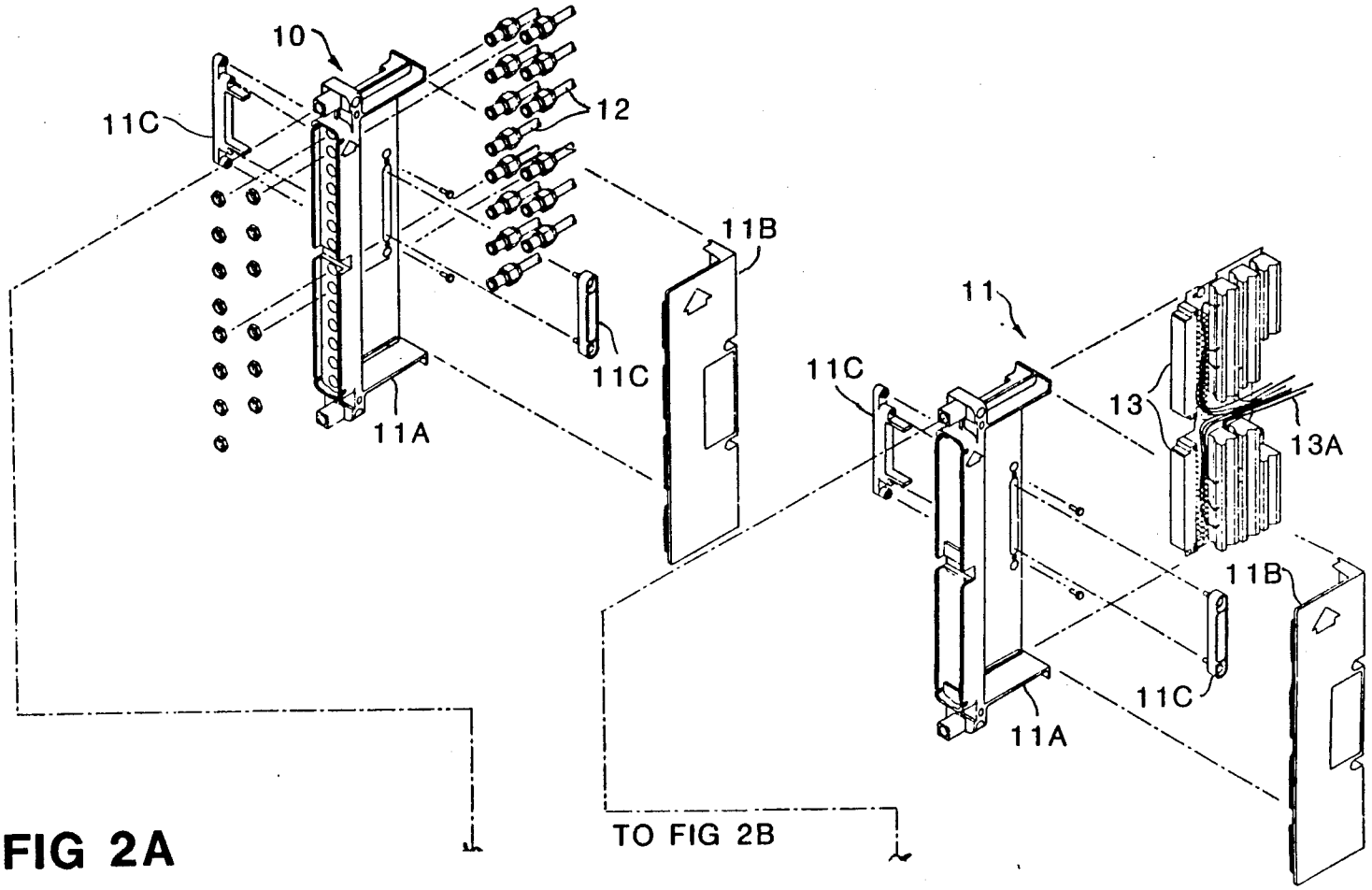
FIGS. 2A & 2B are exploded views illustrating several terminal blocks and an interconnect module used in the present invention.

The housing may include removable wall sections to facilitate assembly and disassembly, etc. This is further illustrated in FIGS. 2A and 2B. The housing is preferably made of impact-resistant plastic for good durability, ease of manufacture, and economical production.

If desired, the terminal block may also include means for connecting to chassis ground through a metal strain relief, shield and grounding retainer This allows shielding of incoming electrical cables to preserve signal integrity. This may be provided by including a grounding pin within the aperture 21 of projection 20 in a manner such that the alignment pin in a printed circuit card contacts the ground pin in projection 20 when the terminal block is interfaced with the printed circuit card.

Figure 2B:
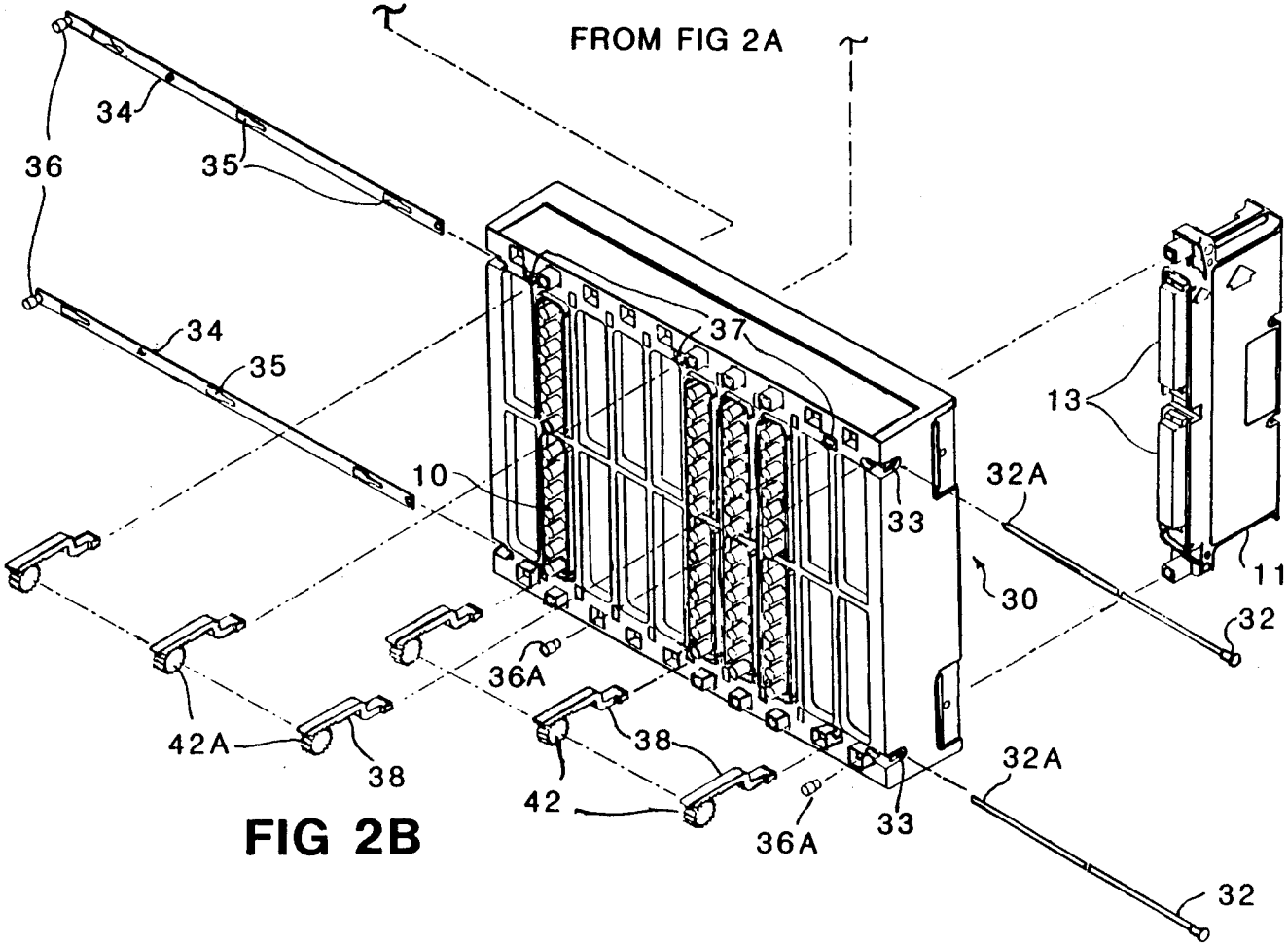

FIG. 2B is an exploded view illustrating several terminal blocks 10 which are slidably received in an interconnect module 30. There is also illustrated a terminal block 11 which is fully assembled and ready to be slidably received in interconnect module 20. Terminal block 11 includes banks 13 of electrical connectors on its front face.

There is also illustrated in an exploded view another terminal block 11 comprising housing portions 11A and 11B, banks of electrical connectors 13, wires 13A which are fastened to the connectors, and securement means 11C for securing the electrical connectors in the housing.

There is further illustrated an exploded view of another terminal block 10 comprising housing portions 11A and 11B, electrical connectors 12, and securement means 11C for securing the electrical connectors in the housing.

After the terminal blocks have been inserted into the interconnect module 30 they can be retained therein by means of elongated rods 32 which are adapted to pass through openings 33 in the sides of module 30 and then through the apertures 22 in each of the several terminal blocks. One end 32A of each rod 32 is threaded so that it may be threadably received in a threaded member carried by the far side wall of the module.

Preferably the apertures 22 in the terminal block housings have a larger diameter than rods 32 so that each terminal block may move or float slightly relative to rods 32 and the module framework. This allows the terminal block to move slightly, as required, with respect to module 30 when the alignment pins on a printed circuit card are slidably received within openings 21 of projections 20 on the housing of the terminal block.

Also illustrated in FIG. 2B are the latch means 34 for enabling the interconnect module 30 to be detachably connected to retractable support members 38 carried by the frame assembly at the opening in a mainframe card cage. The latch means 34 preferably comprises one or more elongated bars which include one or more slots 35 therein. Each slot includes a wide portion and a narrow portion, as illustrated.

Each latch bar 34 is slidably received within a transverse opening parallel to the front face of the module. Preferably there are two such latch bars, one located near the top of the interconnect module and one located near the bottom of the module.

The latch bar 34 includes a handle or knob 36 at one end thereof. After the latch bar has been inserted into the transverse opening in the module another handle or knob 36A may be threadably secured to the opposite end of the latch bar.

The latch bar may be freely moved laterally between first and second positions by means of handle members 36 and 36A. Each slot 35 in bar 34 registers with an opening 37 in the front face of the module. The outer end of a support member 38 is adapted to be slidably received in an opening 37 in module 30. When the bar 34 is in one position the wide portion of the slot 35 registers with opening 37, and when bar 34 is moved laterally to its other position the narrow portion of the slot 35 registers with opening 37 and captures the end of support member 38 and prevents separation of the interconnect module from the support member. When the latch bar is moved laterally to its position where the wide portion of the slot is registered with the opening 37 the module is unlatched.

Also shown in FIG. 2B are toothed gears 42 and 42A which are adapted to drive the support members 38 outwardly away from the frame assembly or inwardly toward the frame assembly surrounding the opening in a mainframe card cage, as explained in more detail hereinafter.

Figure 3:
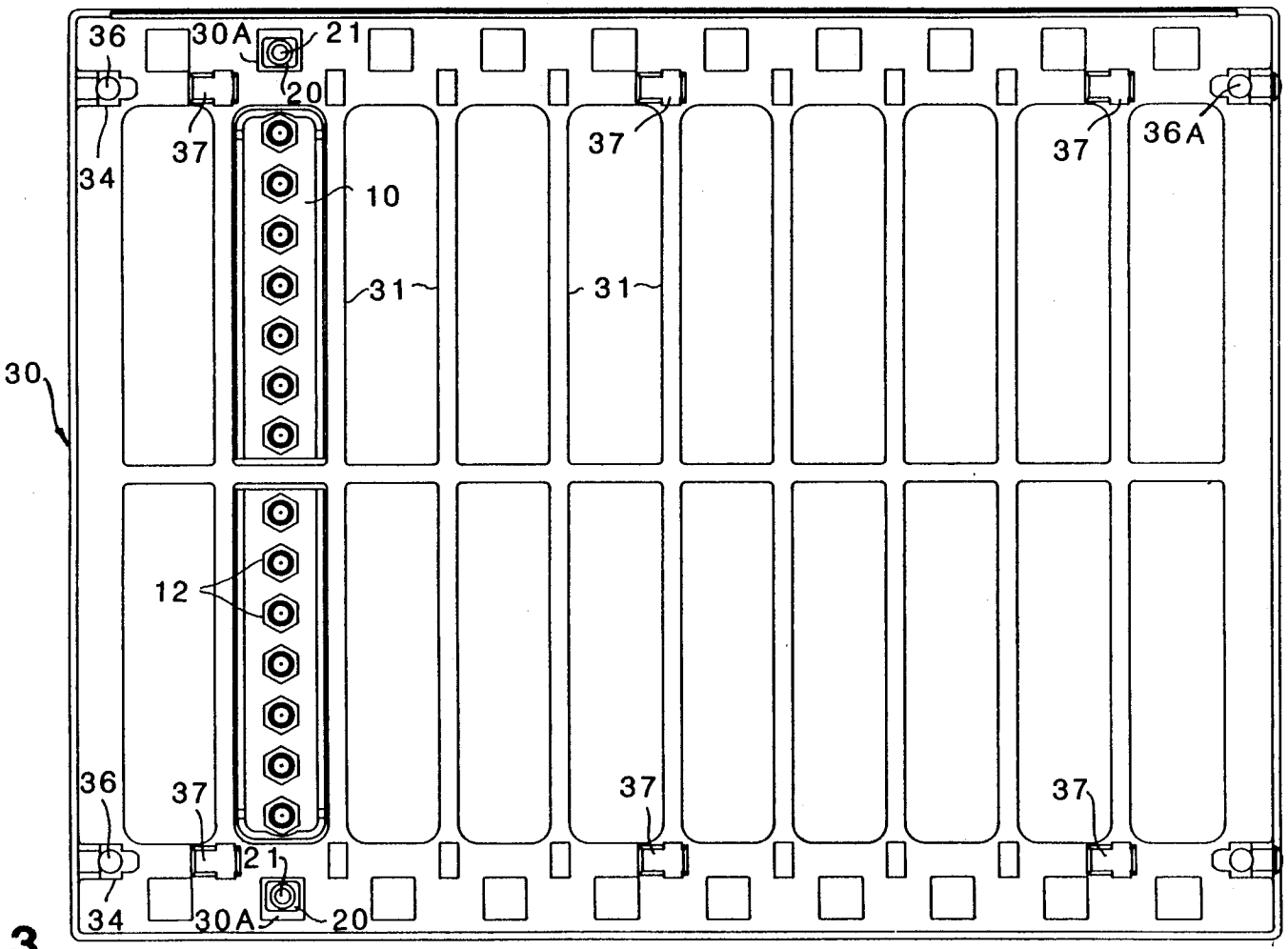
FIG. 3 is a front elevational view of an interconnect module with a terminal block mounted and retained therein.

FIG. 3 is a front elevational view of the interconnect module 30 in which terminal block 10 is retained. In this view the ends of the latch bars 34 are visible as are the handles or knobs 36 and 36A. Openings 37 for receiving the outer ends of the retractable support members are also visible. The projection members 20, and alignment apertures 21, are also visible as they project outwardly through openings 30A in the front face of the module 30.

The interconnect module 30 includes several compartments which are separated by wall members or dividers 31. The member of terminal blocks which the module 30 may accommodate may vary. Preferably the module will accommodate a sufficient number of terminal blocks which may be required to interface with all of the electrical leads which are accessible at the opening in the mainframe card cage. Typically the module can accommodate ten terminal blocks, as illustrated.

FIG. 4 is a rear elevational view of the interconnect module 30 shown in FIG. 3. In this view the elongated rods 32 are visible near the top and bottom of the module for retaining the terminal block 10 within the module. The latch bars 34 and slots 35 are also visible. The square corners 23A and rounded corners 24A in each compartment are also visible.

Figure 5:
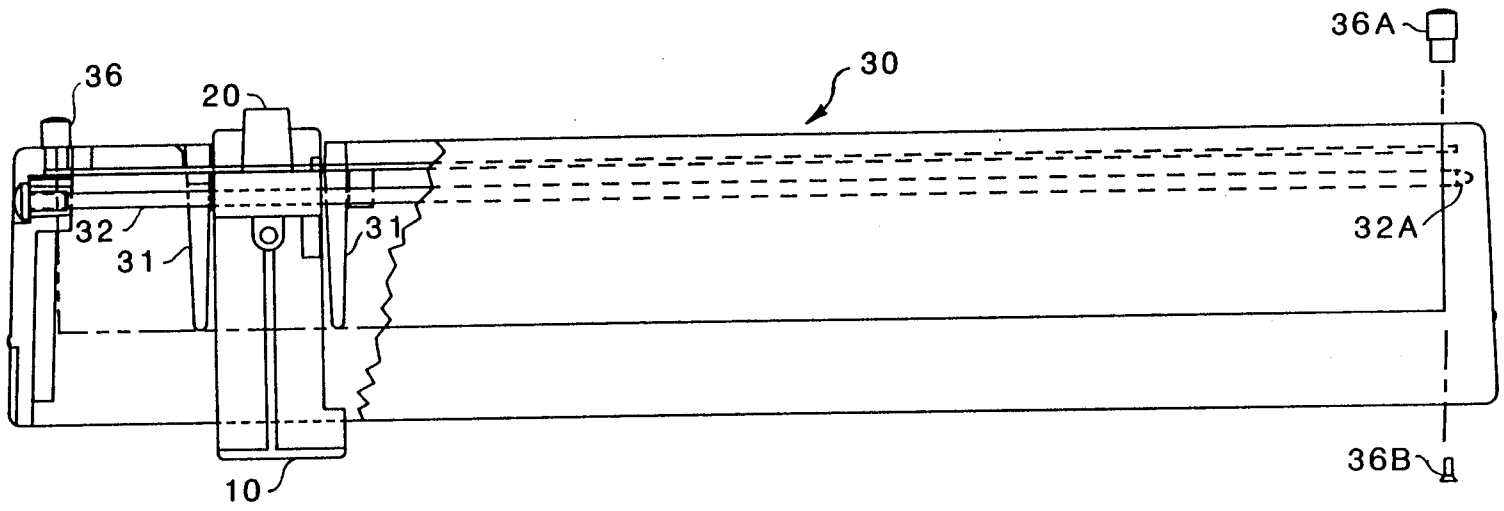
FIG. 5 is a partial cut-away top view of the interconnect module and terminal block combination shown in FIG. 3.

FIG. 5 is a top view of the interconnect module 30 shown in FIGS. 3 and 4 containing terminal block. The module is shown in partial cut-away. Rod 32 is visible, as is latch bar 34. Knob or handle 36 is secured to the end of latch bar 34 by means of screw 36B.

Figure 6:
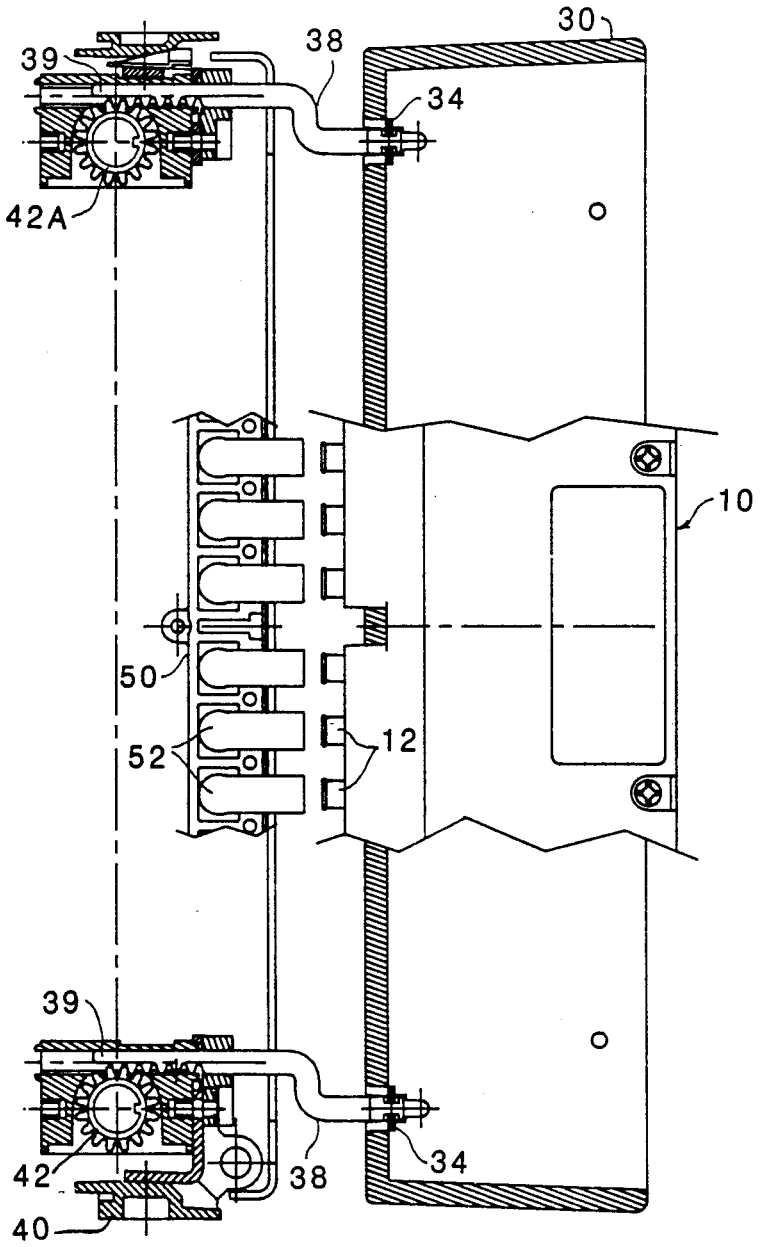
FIG. 6 is a side elevational view illustrating the manner in which the interconnect module is supported on retractable support members carried by a frame assembly at the opening in a mainframe card cage.

FIG. 6 is a side elevational view showing interconnect module 30, containing terminal block 10, attached to the outer ends of retractable support members 38. The latch bars 34 carried by module 30 releasably secure the module 30 to the support members 38.

Support members 38 are carried by the frame assembly 40 which surrounds the opening of a mainframe card cage in which the leads 52 of a printed circuit card 50 are accessible. The inner end 39 of each support member comprises a rack having teeth which are adapted to mesh with the teeth on rotatable gears 42 (on the bottom of the frame) and 42A (on the top of the frame).

An arm or handle 61 (shown in FIGS. 8A and 8B) is operatively connected to gears 42 and 42A in a manner such that pivoting the arm in one direction causes the gears 42 and 42A to rotate in one direction to drive the support members 38 outwardly, as shown in FIG. 6. The gears 42 are secured to a horizontal shaft. The arm or handle 61 is also secured to the shaft so that pivoting of the arm or handle causes the shaft (and the gears 42) to rotate accordingly.

Figure 7:
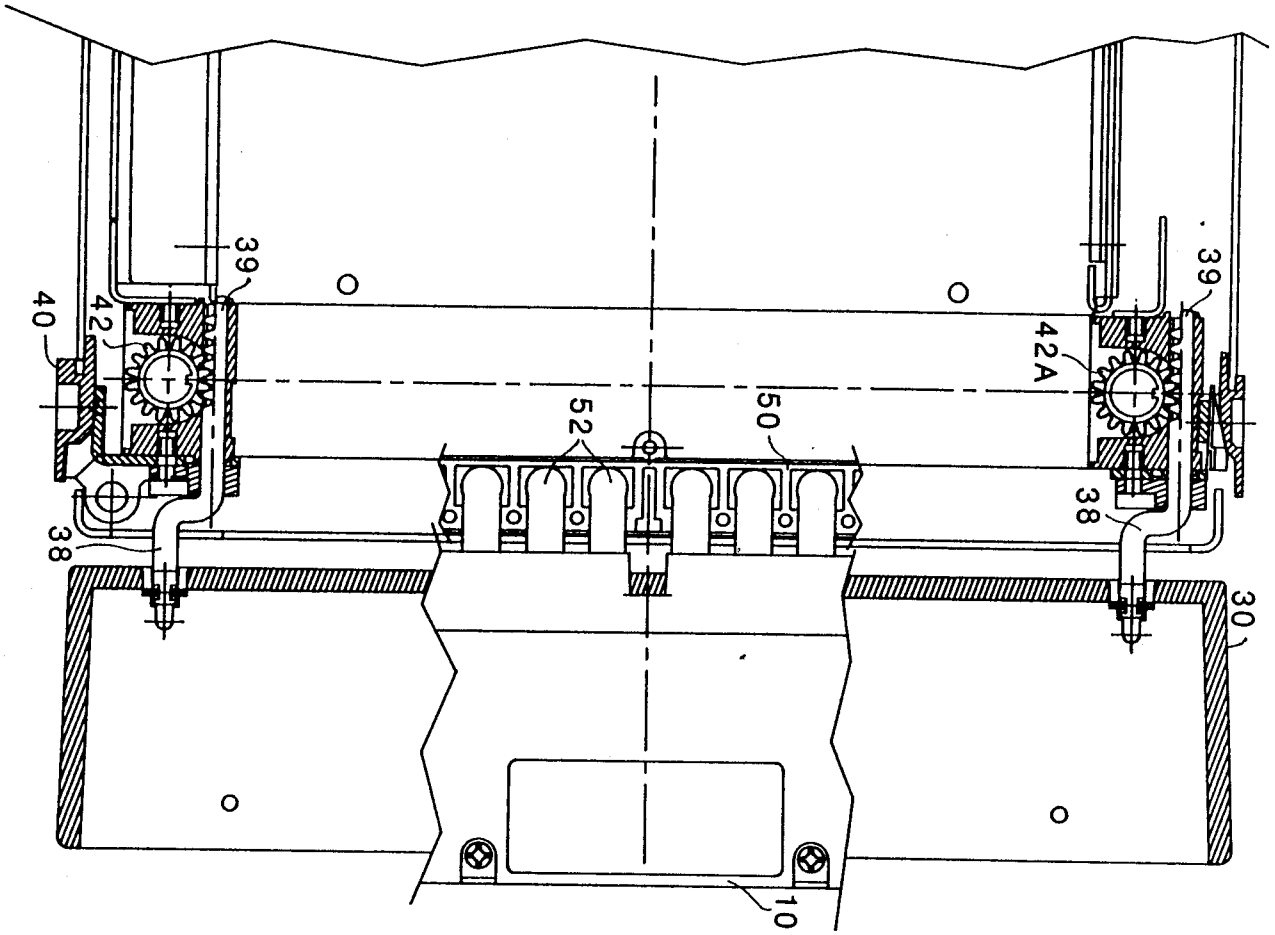
FIG. 7 is a side elevational view illustrating the manner in which a terminal block in the interconnect module is interfaced with the leads of a printed circuit card in the mainframe card cage when the support members are retracted into the frame assembly on the card cage.

When the arm 61 is pivoted in the opposite direction the gears 42 and 42A are rotated in a manner so as to retract support members 38 inwardly toward the frame assembly 40, as shown in FIG. 7. When the support members are retracted into the frame 40 to their maximum extent, the electrical connectors on the front face of terminal block 10 are coupled with the electrical leads 52 on the printed circuit card 50.

Figure 8A:
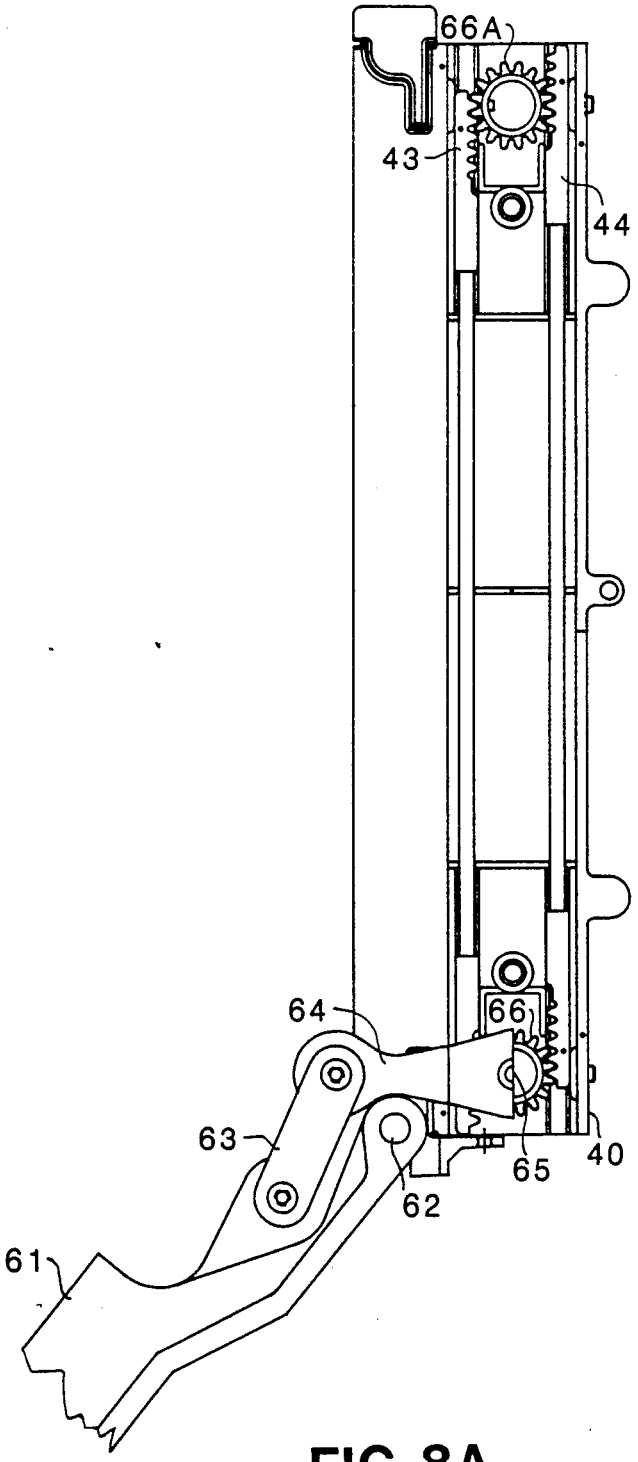
FIGS. 8A and 8B are side elevational views illustrating the manner in which the arm means is movable between first and second positions for causing the support members for the interconnect module to be moved outwardly and inwardly, to thereby interface the terminal block with the electrical leads on the edge of printed circuit cards in the mainframe card cage.
Figure 8B:
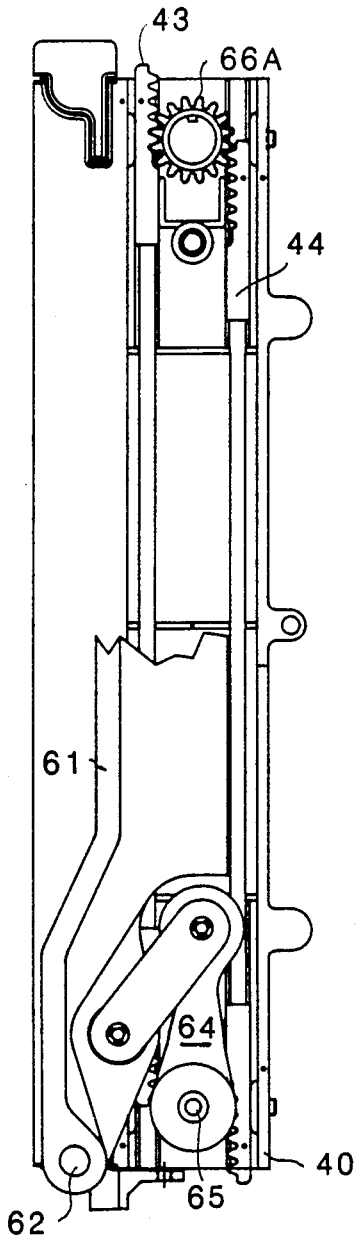

FIGS. 8A and 8B are side elevational views illustrating the arm means which is pivotable between a first position (shown in FIG. 8A) and a second position (shown in FIG. 8B) to cause the support members to move outwardly and inwardly.

The arm means includes main arm 61 which is pivotally mounted on shaft 62 supported by frame assembly 40. Arm 64 is mounted at one end to rotatable axle 65 on which gears 42 are mounted. The opposite end of arm 64 is pivotally mounted to one end of linkage arm 63, while the opposite end of linkage arm 63 is pivotally mounted to arm 61, as illustrated.

The type of linkage arrangement illustrated in FIGS. 8A and 8B provides a significant mechanical advantage and thus allows tremendous rotational force to be applied to gears 42 by main arm 61. This permits a large interconnect module containing several terminal blocks to be interfaced with the electrical leads on the edges of numerous printed circuit cards simultaneously with little exerted force on arm 61, even though the total insertion force may be several hundred pounds. A person may pivot the arm 61 to easily effect a connect or disconnect operation in this manner.

Force is transmitted to gears 42A on the upper portion of the frame assembly by means of vertically disposed slider arms 43 and 44 which have teeth on each end thereof, as illustrated. The teeth on the lower ends of the slider arms are meshed with the teeth of the gear 66 which is secured to arm 64, and the teeth on the upper ends of the slider arms are meshed with the teeth of the gear 66A, as illustrated. Gears 42A at the top portion of the frame assembly are secured to a horizontal shaft which is also secured to gear 66A. In this manner gears 42A are adapted to drive the retractable support members which are carried on the top of the frame assembly.

Figure 9:
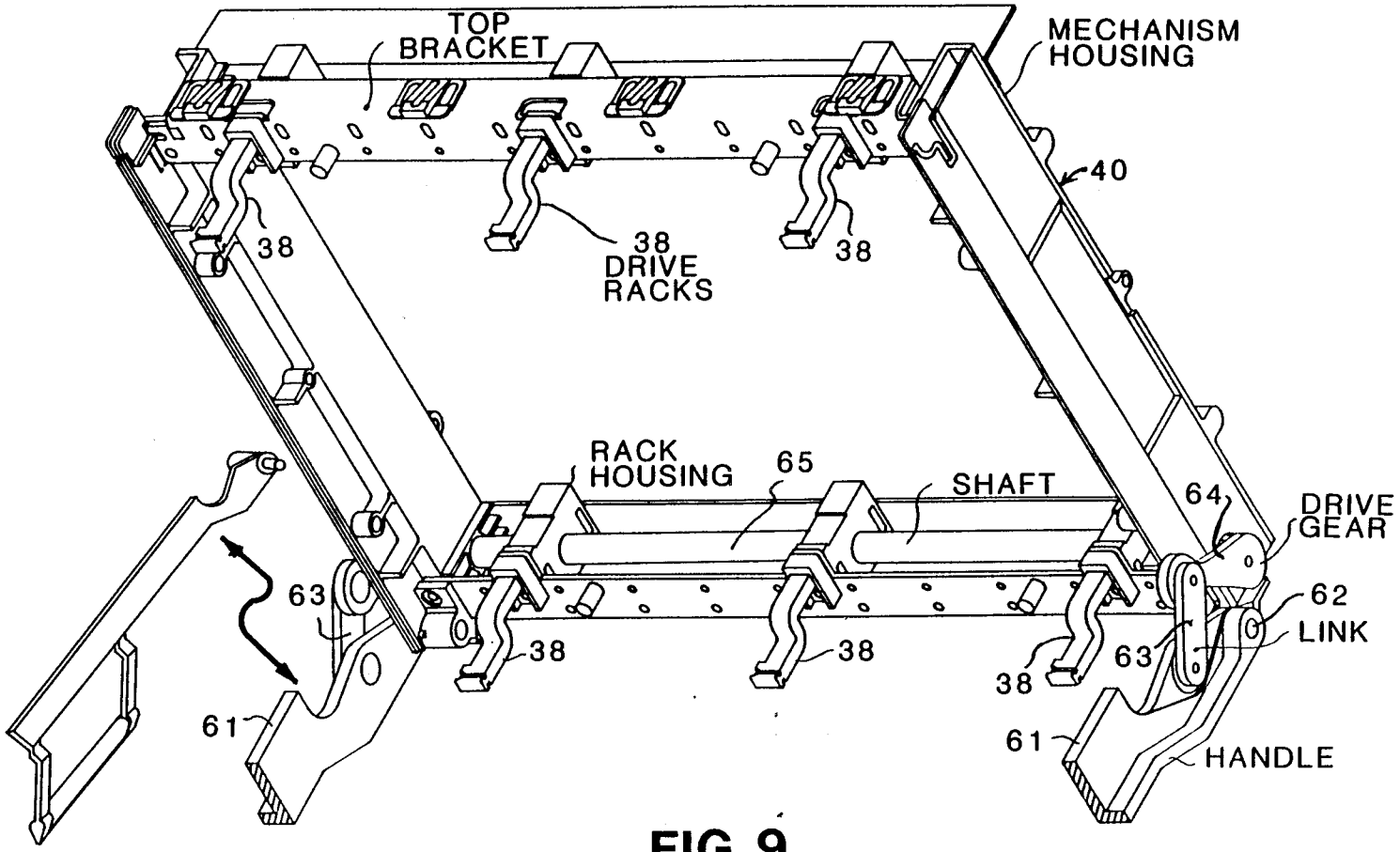
FIG. 9 is a front isometric view of the frame assembly attached at, and surrounding, the opening in a mainframe card cage.

FIG. 9 illustrates the frame assembly secured around the opening in a mainframe card cage. This view illustrates a preferred embodiment in which there are two such arm or handle members 61, one arm being located on each side of the frame assembly 40. The arms are shown in their lower position and the support members are in their outward position. When the arms 61 are raised to their upward position the support members 38 are caused to retract into the frame assembly 40. The interconnect module is adapted to be releasably secured to the outer ends of the support members, as previously described.

What is claimed is:

1. A method for interconnecting a bank of electrical connectors with electrical leads on printed circuit cards which are accessible at the opening of a mainframe card cage, wherein said method comprises the steps of:

(a) attaching a frame assembly to said opening of said mainframe card cage, wherein said frame assembly includes (i) a plurality of retractable support members, and (ii) arm means carried by the frame assembly and being adapted to move the support member outwardly from the frame and inwardly toward the frame assembly;

(b) securing a bank of electrical leads in a terminal block comprising (i) a housing having front and rear faces, (ii) a plurality of elongated electrical conductors secured to the electrical connectors and extending rearwardly through the rear face of the housing, and (iii) alignment means carried by the front face of the housing and being adapted to align said bank of electrical connectors with said electrical leads on said printed circuit card;

(c) retaining said terminal block in an interconnect module which is adapted to be attached to said retractable support members of said frame assembly;

(d) attaching said interconnect module to said retractable support members; and (e) moving said arm means so as to move said support members toward said frame assembly in a manner such that said electrical connectors become coupled to said electrical leads on said printed circuit card.

* * * * *

UNITED STATES PATENT AND TRADEMARK OFFICE

CERTIFICATE OF CORRECTION

PATENT NO. : 4,893,405

DATED : January 16, 1990

INVENTOR(S) : Roy Pennington

It is certified that error appears in the above-identified patent and that said Letters Patent is hereby corrected as shown below:

ON TITLE PAGE:

In the title, "CORRECTING" should read -- CONNECTING --;

In the Abstract, Line 19, "menas" should read -- means --.

Signed and Sealed this

Twenty-second Day of October, 1991

*Attest:*

HARRY F. MANBECK, JR.

*Attesting Officer*

*Commissioner of Patents and Trademarks*